United States Patent [19]

Kirkpatrick

[11] 4,191,419

[45] Mar. 4, 1980

[54] HINGE MECHANISM FOR FOLDING CHAIRS

[76] Inventor: Michael F. Kirkpatrick, Lincoln Center, Lincoln Rd., Lincoln, Mass. 01773

[21] Appl. No.: 955,103

[22] Filed: Oct. 26, 1978

[51] Int. Cl.[2] ..... A47C 4/10

[52] U.S. Cl. ..... 297/48; 16/144

[58] Field of Search ..... 297/48, 16, 55, 52, 297/379; 16/144, 162, 191; 5/57 B

[56] References Cited

U.S. PATENT DOCUMENTS

| | | | |
|---|---|---|---|
| 3,065,498 | 11/1962 | Johnson | 16/191 |
| 3,078,957 | 2/1963 | Larson | 16/144 |
| 3,857,604 | 12/1974 | Scott | 297/52 X |

*Primary Examiner*—Francis K. Zugel

*Attorney, Agent, or Firm*—Thompson, Birch, Gauthier & Samuels

[57] ABSTRACT

A folding chair is disclosed having a back rest with terminal ends, interconnected pairs of first and second legs, and a seat pivotally connected to the second legs. The chair is adjustable between a folded position with the first and second legs, the seat and the back rest substantially parallel, and an open position with the first and second legs and the back rest angularly disposed relative to each other and with the seat resting on supports carried by the first legs. Hinge mechanisms pivotally connect each terminal end of the back rest with a first leg and a second leg. The hinge mechanisms include releasable locking means for fixing the back rest relative to the legs when the chair is in the open position.

7 Claims, 11 Drawing Figures

HINGE MECHANISM FOR FOLDING CHAIRS

TECHNICAL FIELD

This invention relates generally to folding chairs having pivotal back rests, and is concerned in particular with a hinge mechanism for pivotally connecting the back rest to the chair legs and for releasably locking the back rest in a fixed position relative to the chain legs when the chair is in the open position.

BACKGROUND OF THE INVENTION

A number of folding chair designs have heretofore been developed. One such design is disclosed in U.S. Pat. No. 2,991,123 (Hamilton), where the curved back rest is fixed relative to the front chair legs. This arrangement has the disadvantage of not being able to be folded to a compact state with all of the chair elements in a substantially parallel relationship. This in turn complicates storage and handling of such chairs.

Another known design embodying a pivotal back rest is shown in U.S. Pat. No. 3,587,604 (Scott). While this design can be folded into a more compact state with all elements substantially parallel, it has the disadvantage of having the back rest remain in a freely pivotal state when the chair is either in the open or folded positions. This makes it awkward and sometimes difficult to handle the chair in its open position, and also makes it impossible to lean the folded chair on its back rest against a wall or another chair.

BRIEF SUMMARY OF THE INVENTION

The present invention eliminates the above-described problems by providing an improved hinge mechanism for pivotally connecting the back rest to the chair legs. This hinge mechanism permits the legs and back rest to assume a neat, compact, substantially parallel relationship when the chair is folded, and further embodies a releasable locking means which fixes the back rest relative to the chair legs when the chair is in the open position.

Other objects and advantages of the present invention will become more apparent as the description proceeds with the aid of the accompanying drawings.

DETAILED DESCRIPTION OF THE INVENTION

Figure 1:
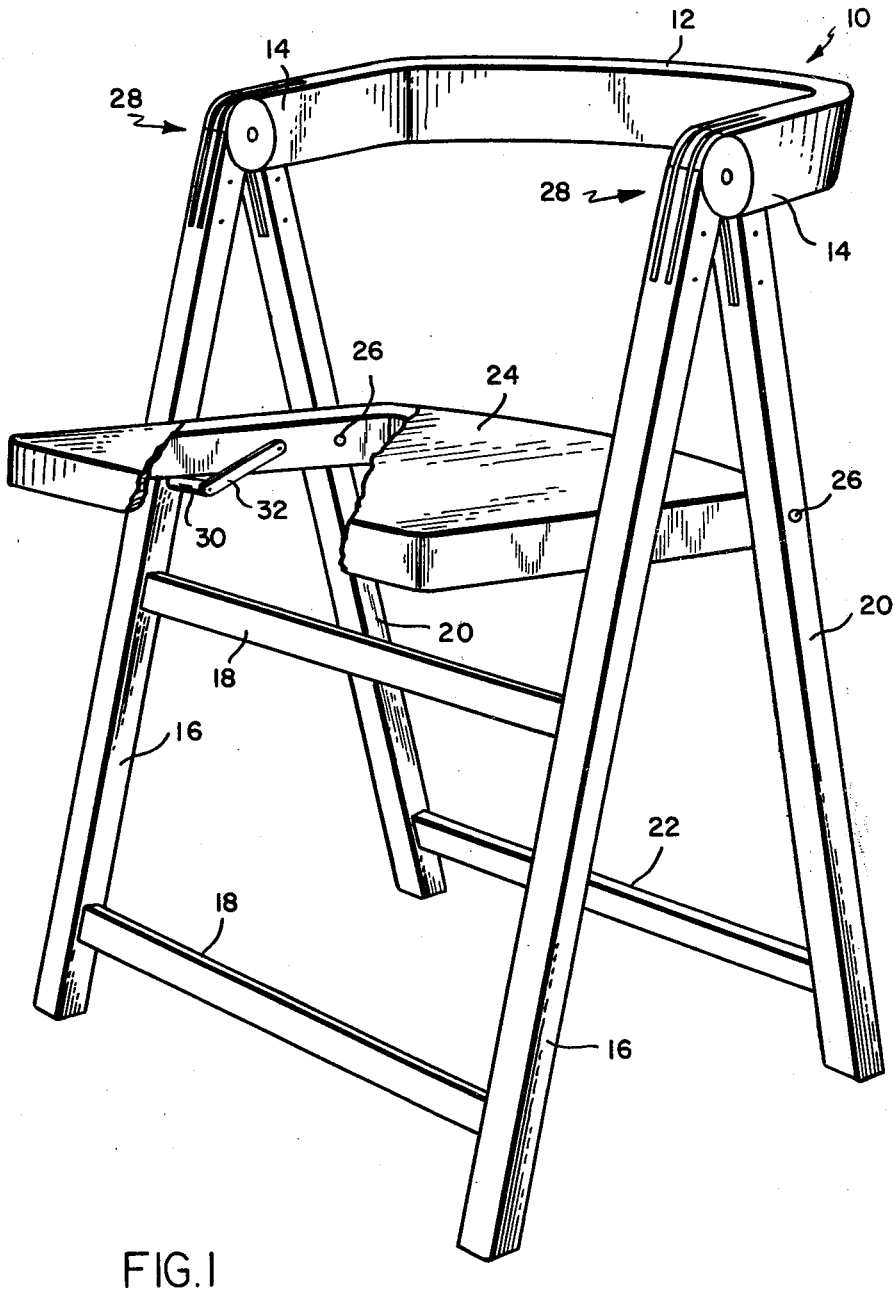
FIG. 1 is a view in perspective of a folding chair embodying hinge mechanisms in accordance with the present invention, the chair being shown in the open position.

Referring initially to FIG. 1, a folding chair 10 embodying hinge mechanisms in accordance with the present invention is shown including the following components: a back rest 12 having a generally U-shaped configuration with terminal ends 14; a pair of "first" or front legs 16 interconnected by cross braces 18; a pair of "second" or back legs 20 interconnected by cross brace 22; and a seat 24 pivotally connected to the second or back legs as at 26. Each terminal end 14 of the back rest 12 is connected to a first leg 16 and a second leg 20 by means of a hinge mechanism 28 of the present invention.

In the open position as shown in FIG. 1, the chair 10 has its first and second legs 16, 20 and its back rest 12 angularly disposed relative to each other, with the back rest extending rearwardly, and with the seat 24 extending forwardly and resting on pin-type supports 30 (only one being shown) carried by the first legs 16. Preferably, links 32 are pivotally connected at opposite ends to the supports 30 and the seat 24.

Figure 2:
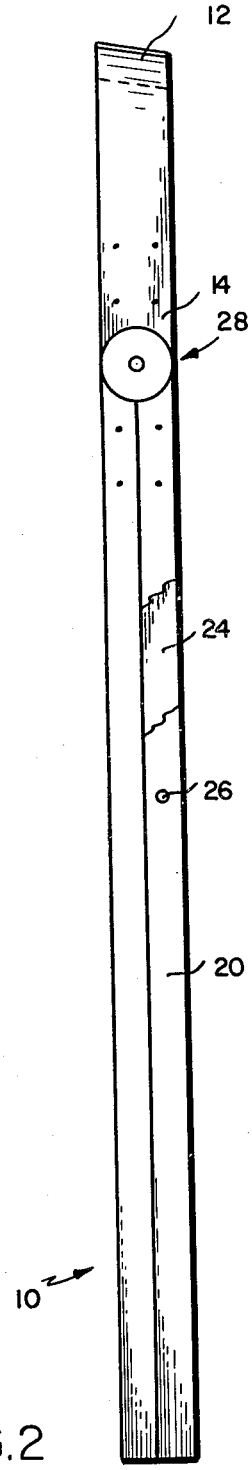
FIG. 2 is a side view of the same chair in the folded position.
Figure 4:
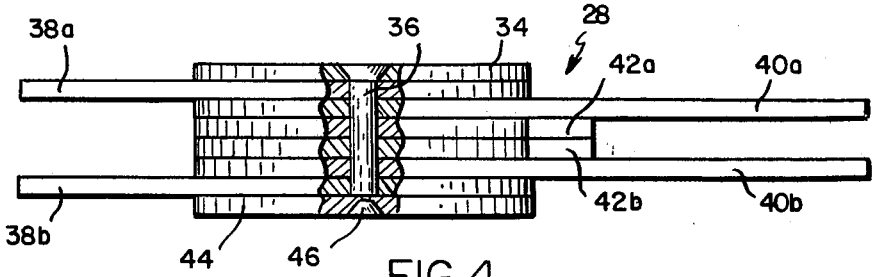
FIG. 4 is a top plan view of the hinge mechanism shown in FIG. 3.
Figure 5:
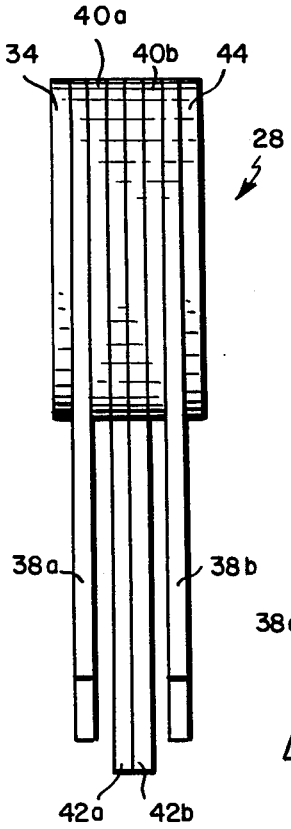
FIG. 5 is an end view of the hinge mechanism shown in FIG. 3.
Figure 3:
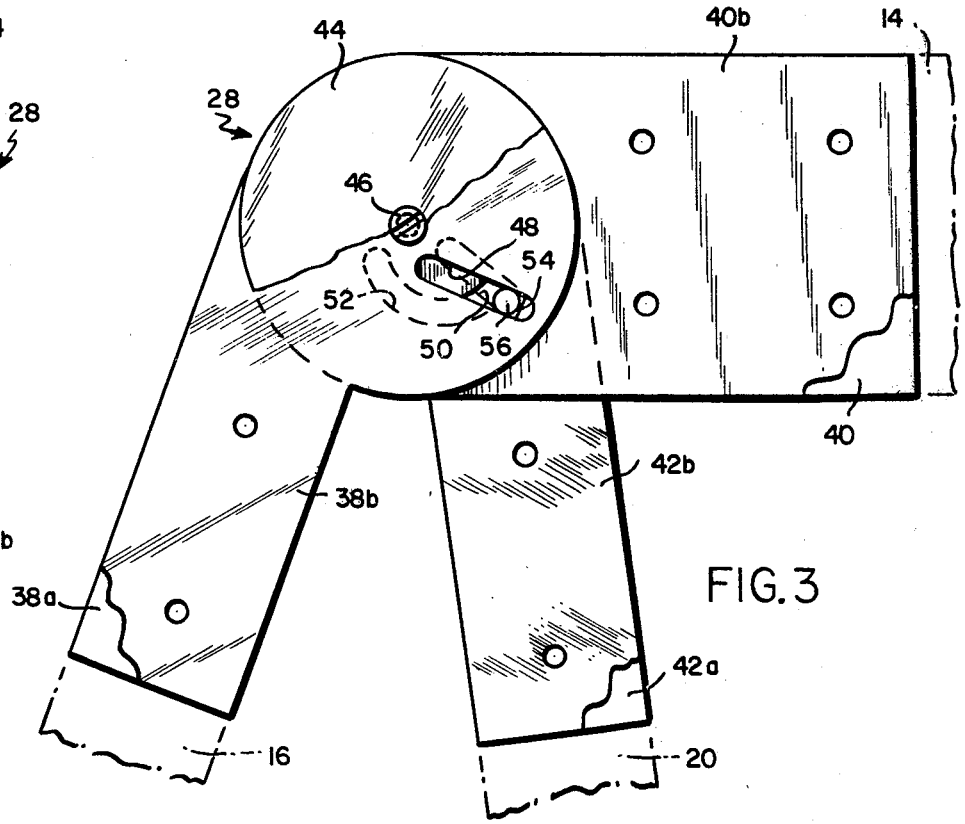
FIG. 3 is a side view of a hinge mechanism in accordance with the present invention, with a portion of the facing circular retainer plate partially broken away.
Figure 6:
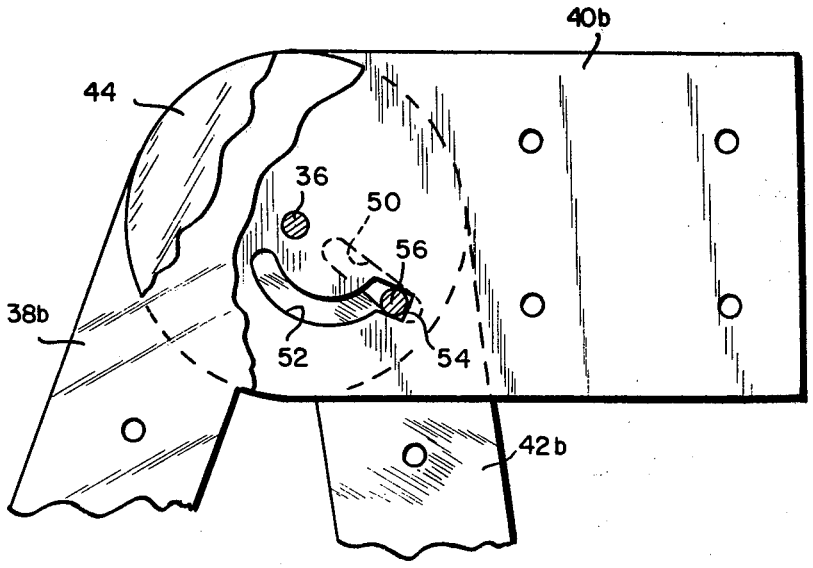
FIG. 6 is a view similar to FIG. 3 with additional elements broken away.
Figure 7:
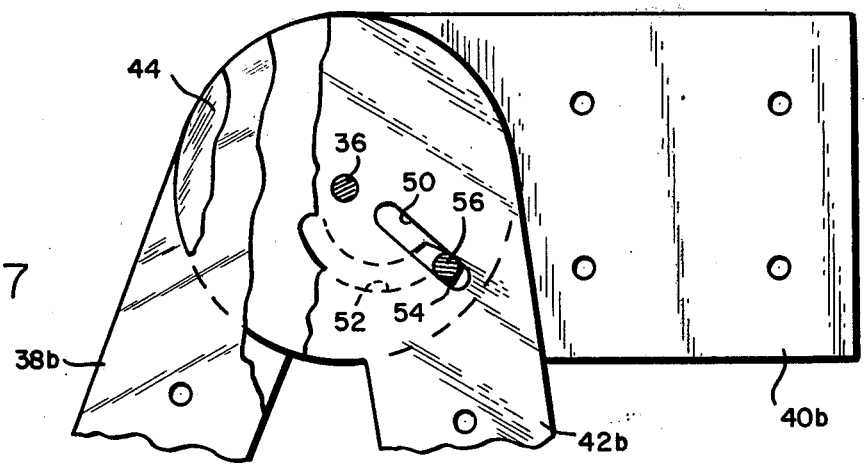
FIG. 7 is a view similar to FIG. 6 with still additional elements broken away.

When the chair is collapsed to the folded position shown in FIG. 2, the seat 24 is pivoted to a nested position between the second legs 20, and the back rest 12, the first and second legs 16, 20 and the seat 24 are all arranged in a neat, compact substantially parallel relationship.

Referring now to FIGS. 3–7 and 11, it will be seen that each hinge mechanism includes an outer circular retainer plate 34 with a pivot pin 36 protruding centrally therethrough. Continuing in sequence from retainer plate 34, the hinge mechanism further includes a first leg element 38*a;* a back rest element 40*a;* two second leg elements 42*a, 42b;* another back rest element 40*b;* another front leg element 38*b;* and another circular retainer plate 44 held in place by a screw 46 threaded into the end of the pivot pin 36.

The back rest elements 40*a, 40b* are conveniently inserted into slots in the terminal end 14 of the back rest 12 and are fixed in place by any suitable means, for example by means of pins or rivets. The first leg elements 38*a, 38b* are similarly connected to the first legs 16, as are the second leg elements 42*a, 42b* to the second legs 20.

Figure 11:
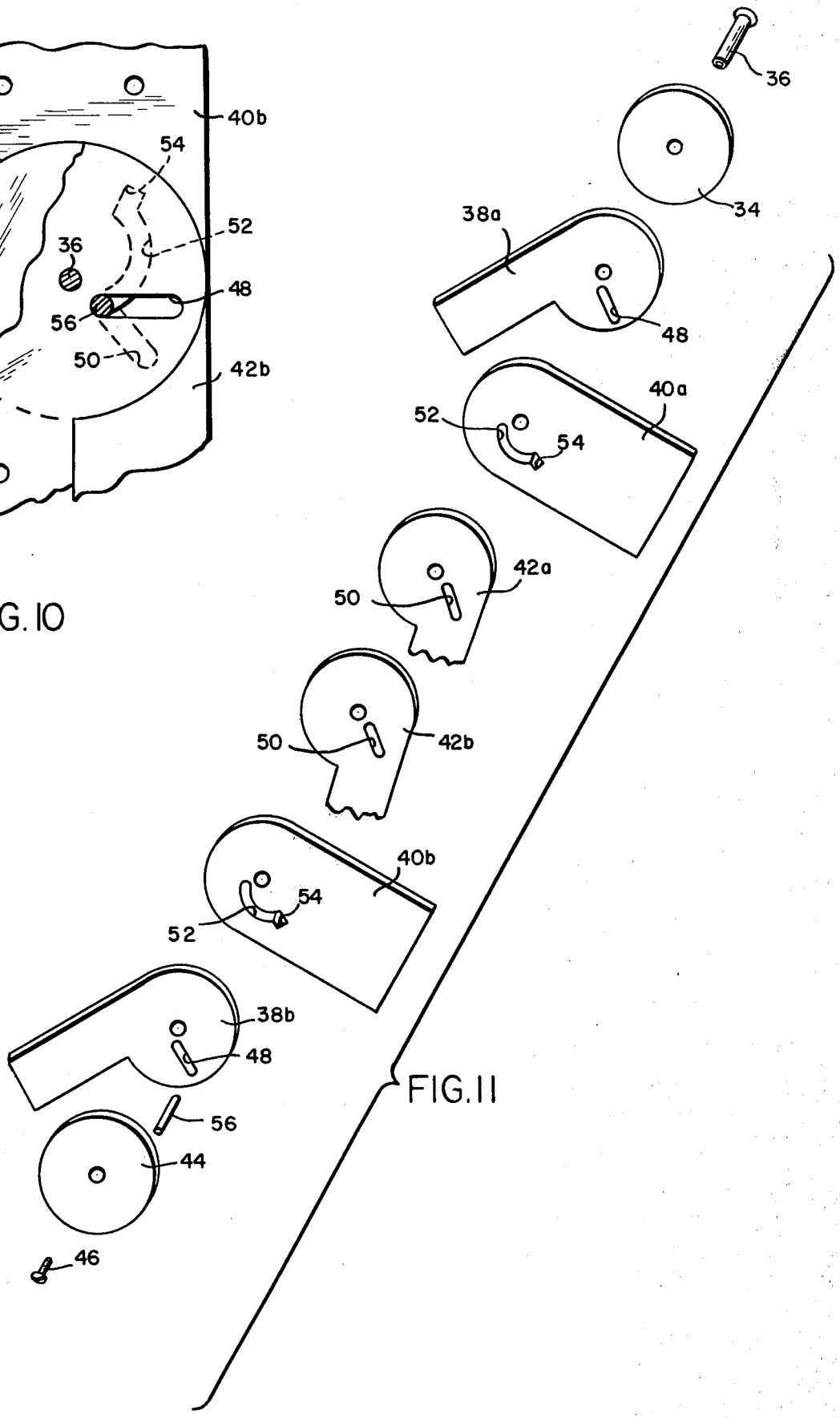
FIG. 11 is an exploded view of the hinge mechanism.

As is best shown in FIG. 11, the first leg elements 38*a, 38b* have straight slots 48 and the second leg members 42*a, 42b* have similar straight slots 50. The back rest members 40*a, 40b* have curved slots 52 which terminate at one end in locking notches 54. The slots 48, 50 and 52 are at all times at least partially aligned to thus accommodate a locking pin 56 extending therethrough in a direction parallel to the pivot pin 36. The locking pin 56 is axially captured between the outer retainer plates 34, 44.

When the chair is in the open position as shown in FIG. 1, the various components of the hinge mechanisms are positioned as shown in FIGS. 3–7, with the locking pin 56 seated in the locking notches 54 of the back rest elements 40*a, 40b*, and with the straight slots 48, 50 of the front leg elements 38*a, 38b* and rear leg elements 42*a, 42b* angularly arranged relative to each other. The seating of the locking pin 56 in the locking notches 54 provides a releasable locking means which fixes the back rest 12 relative to the leg 16, 20. Thus, the chair can be grasped by the back rest and moved about without the back rest pivoting in the user's hands.

Figure 8:
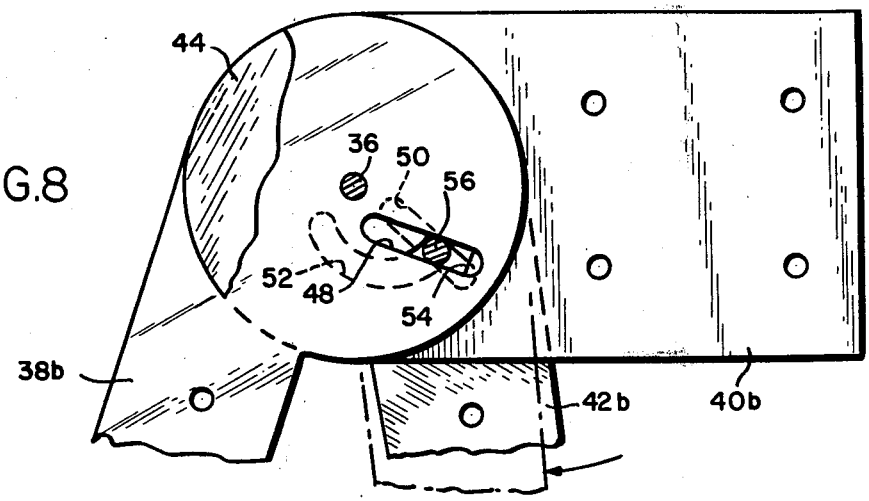
FIGS. 8–10 are views similar to FIG. 3 showing the relative movement of the hinge mechanism components as the chair is collapsed from the open position shown in FIG. 1 to the closed position shown in FIG. 2.
Figure 9:
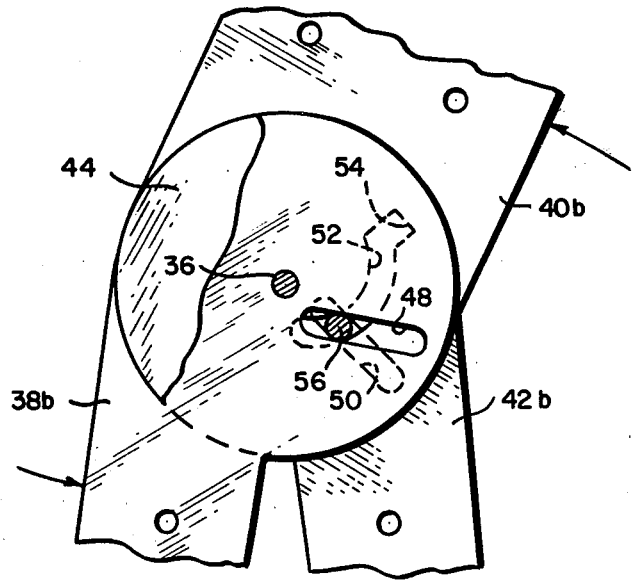

When the chair is to be collapsed to the folded position shown in FIG. 2, the chair is tilted forward on its first legs 16 and the second legs 20 are pivoted slightly towards the first legs. With the chair embodiment herein disclosed, this is conveniently accomplished by pivotally raising the seat 24, which acts through the connecting links 32 and the supports 30 to pull the second legs 20 towards the first legs 16. As indicated diagrammatically by the arrow in FIG. 8, this slight pivotal movement is transferred to the second leg elements 48*a*, 48*b*. When this occurs, the straight sides of the angularly disposed slots 48, 50 coact to exert a force on the locking pin 56. This force moves the locking pin towards the pivot pin 36. The initial movement of the locking pin results in it being lifted out of the locking notches 54 into alignment with the curved slots 52. Thereafter, as the locking pin 56 continues to move towards the pivot pin 36 (see FIG. 9) the back rest 12 and the back rest elements 40*a*, 40*b* are pivoted about pivot pin 36 in a direction opposite to the pivotal movement of the first legs 16 and the first leg elements 38*a*, 38*b*. As the locking pin 56 moves towards the pivot pin 36, it travels along the angularly disposed straight slots 48,50 and along the curved slots 52. It will thus be seen that pivotal motion of the back rest is at all times controlled by the coaction between the curved slots 52 and the locking pin 56, which in turn means that except for the time during which the locking pin is moving into and out of the locking notches 54, pivotal movement of the back rest 12 is always accompanied by relative pivotal movement of the chair legs.

Figure 10:
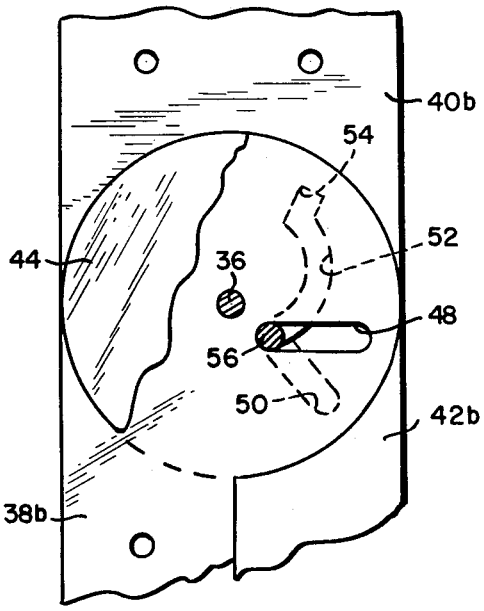

In the folded position as shown in FIG. 10, the locking pin 56 is located at the innermost ends of the slots 48, 50, 52, and the back rest elements 40*a*, 40*b* are substantially parallel to both the first leg elements 38*a*, 38*b* and the second leg elements 42*a*, 42*b*. This enables the chair components to be arranged in the neat, parallel, compact arrangement shown in FIG. 2. The back rest 12 can then be conveniently employed as a handle to carry the chair about. Moreover, since the back rest is relatively small and light in comparison to the first and second leg assemblies, the back rest will have a tendency to remain as shown in FIG. 2 when the chair is folded. This in turn makes it possible to use the back rest as a support when leaning the folded chair against a wall or another chair.

Under certain circumstances, it may be convenient to pivotally mount the seat 24 on the front legs 16 and to arrange the supports 30 on the back legs 20. Under such circumstances, the back legs would be considered as the "first" legs and the front legs would be considered as the "second" legs.

I claim:

1. In a folding chair having a back-rest with terminal ends, interconnected pairs of first and second legs, and a seat pivotally connected to the second legs, said chair being adjustable between a folded position with the first and second legs, the seat and the back-rest substantially parallel, and an open position in which the first and second legs and the back-rest are angularly disposed relative to each other with the seat linked to and resting on supports carried by the first legs to hold the first and second legs in an open position, the improvement comprising:

hinge mechanisms pivotally connecting each terminal end of said back-rest with a first leg and a second leg, said hinge mechanisms including releasable gravity-independent locking means responsive only to the angular displacement of the back-rest and legs with respect to each other for fixing the back-rest relative to the legs when the chair is in the open position.

2. The apparatus of claim 1 wherein said hinge mechanisms further include back rest elements attached to the terminal ends of said back rest, first leg elements attached to said first legs, and second leg elements attached to said second legs, each of said elements having superimposed portions pivotally interconnected by a common pivot pin.

3. The apparatus of claim 2 wherein the superimposed positions of said elements are provided with slots which are at all times at least partially aligned, and a locking pin extending through the aligned portions of said slots in a direction parallel to said pivot pin.

4. The apparatus of claim 2 wherein the slots in the first and second leg elements are straight and angularly arranged relative to each other to coact in moving said locking pin relative to said pivot pin in response to relative pivotal movement of said first and second leg elements.

5. The apparatus of claim 4 wherein the slots in said back rest elements are curved and along which said locking pin is moved by the coaction of the slots in said first and second leg elements, the pivotal movement of said back rest in relation to the pivotal movement of the first and second legs being controlled by the coaction of said curved slots with said locking pin.

6. The apparatus of claim 4 wherein said releasable locking means includes locking notches at the ends of said curved slots for receiving said locking pin when the chair is in the open position.

7. The apparatus of claim 6 wherein said locking notches define one end of the path travelled by said locking pin.

* * * * *